US007121357B1

(12) United States Patent
Raimondi

(10) Patent No.: US 7,121,357 B1
(45) Date of Patent: Oct. 17, 2006

(54) METHOD OF INSERTING A GROUNDING ROD

(76) Inventor: Richard Raimondi, 93 Gaywood Ave., Colonia, NJ (US) 07067

( * ) Notice: Subject to any disclaimer, the term of this patent is extended or adjusted under 35 U.S.C. 154(b) by 0 days.

(21) Appl. No.: 10/928,579

(22) Filed: Aug. 30, 2004

(51) Int. Cl.
*B25D 17/12* (2006.01)

(52) U.S. Cl. ..... 173/1; 173/90; 173/91; 173/128; 173/130

(58) Field of Classification Search ..... 173/91, 173/1, 128, 90, 131, 132, 142; 227/147, 227/151, 153; 29/14, DIG. 43, 432, 275
See application file for complete search history.

(56) References Cited

U.S. PATENT DOCUMENTS

| | | | | |
|---|---|---|---|---|
| 2,145,420 | A | 1/1939 | Hornbecker | |
| 2,931,186 | A * | 4/1960 | Frederick | 173/130 |
| 3,391,763 | A | 5/1968 | Matson | |
| 3,937,286 | A * | 2/1976 | Wagner | 173/203 |
| 4,261,424 | A * | 4/1981 | Gonterman et al. | 173/91 |
| 4,310,057 | A * | 1/1982 | Brame | 175/21 |
| 4,315,551 | A | 2/1982 | Iannone | |
| 4,366,870 | A * | 1/1983 | Frederick | 173/131 |
| D284,930 | S | 8/1986 | Richards | |
| 4,676,424 | A * | 6/1987 | Meador et al. | 227/147 |
| 4,813,494 | A * | 3/1989 | Beard et al. | 173/91 |
| 4,960,064 | A * | 10/1990 | Mestas et al. | 114/230.26 |
| 5,123,584 | A * | 6/1992 | Harrison | 227/147 |
| 5,188,187 | A * | 2/1993 | Mumper | 173/128 |
| 5,248,002 | A | 9/1993 | Williams | |
| 5,737,982 | A * | 4/1998 | Lin | 81/58.3 |
| 5,806,608 | A * | 9/1998 | DuBois | 173/90 |
| 5,863,154 | A | 1/1999 | Olsen | |
| 5,988,296 | A * | 11/1999 | Zachman et al. | 173/1 |
| 6,000,302 | A * | 12/1999 | Chiang | 81/177.8 |
| 6,182,772 | B1 * | 2/2001 | Lagasse et al. | 173/1 |
| 6,308,599 | B1 * | 10/2001 | Fu-Hui | 81/490 |
| 6,347,672 | B1 * | 2/2002 | Reardon | 173/90 |
| 6,364,033 | B1 * | 4/2002 | Hung et al. | 173/217 |
| 6,386,075 | B1 * | 5/2002 | Shiao | 81/177.8 |
| 6,588,514 | B1 * | 7/2003 | Kozak | 173/1 |
| 6,915,936 | B1 * | 7/2005 | Estes | 227/147 |
| 6,938,706 | B1 * | 9/2005 | Ng | 173/216 |
| 2006/0005401 | A1 * | 1/2006 | Borinato et al. | 30/388 |

* cited by examiner

*Primary Examiner*—Rinaldi I. Rada
*Assistant Examiner*—Brian Nash

(57) ABSTRACT

A method of inserting a grounding rod includes providing an elongated grounding rod that has an upper end and a lower end and also providing a hammer drill. An elongated tubular member has an open first end and an open second end. The tubular member includes a first portion and a second portion. A dividing wall is integrally attached to an inner surface of the tubular member and is positioned at a juncture of the first and second portions. Te upper end of the grounding rod is extended into the second portion of the tubular member such that the upper end abuts the dividing wall. The hammer drill is engaged with the first portion of the tubular member. The hammer drill is turned on so that the lower end of the grounding rod is extended into a ground surface.

8 Claims, 2 Drawing Sheets

METHOD OF INSERTING A GROUNDING ROD

BACKGROUND OF THE INVENTION

1. Field of the Invention

The present invention relates to grounding rod insertion devices and methods and more particularly pertains to a new grounding rod insertion device and method for driving a grounding rod into a ground surface.

2. Description of the Prior Art

The use of grounding rod insertion devices and methods is known in the prior art. U.S. Pat. No. 5,863,154 describes a telescoping device that aids a person in selectively driving a grounding rod into a ground surface at a selected height. Another type of grounding rod insertion device and method is U.S. Pat. No. 4,315,551 that includes a tube having an open end and a closed end. The open end may receive the grounding rod, and the closed end can be hammered to drive an outer end of the grounding rod into a ground surface. A device similar to this is shown in U.S. Pat. No. 5,248,002, which again has a closed end which may be struck with a hammer.

While these devices fulfill their respective, particular objectives and requirements, the need remains for a device and method that allows a person to use a hammer drill for driving grounding rods into a ground surface. The hammer drill is a small device that is easy to use for driving rods, however no suitable tool has been devised that may allow a hammer drill to be used in the driving of grounding rods into a ground surface. For that reason, a tool is needed that allows a hammer drill to engage a grounding rod.

SUMMARY OF THE INVENTION

The present invention meets the needs presented above by generally comprising providing an elongated grounding rod that has an upper end and a lower end and also providing a hammer drill. An elongated tubular member has an open first end and an open second end. The tubular member includes a first portion positioned adjacent to the first end and a second portion positioned adjacent to the second end. A dividing wall is integrally attached to an inner surface of the tubular member and is positioned at a juncture of the first and second portions. Te upper end of the grounding rod is extended into the second portion of the tubular member such that the upper end abuts the dividing wall. The hammer drill is engaged with the first portion of the tubular member. The hammer drill is turned on so that the lower end of the grounding rod is extended into a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
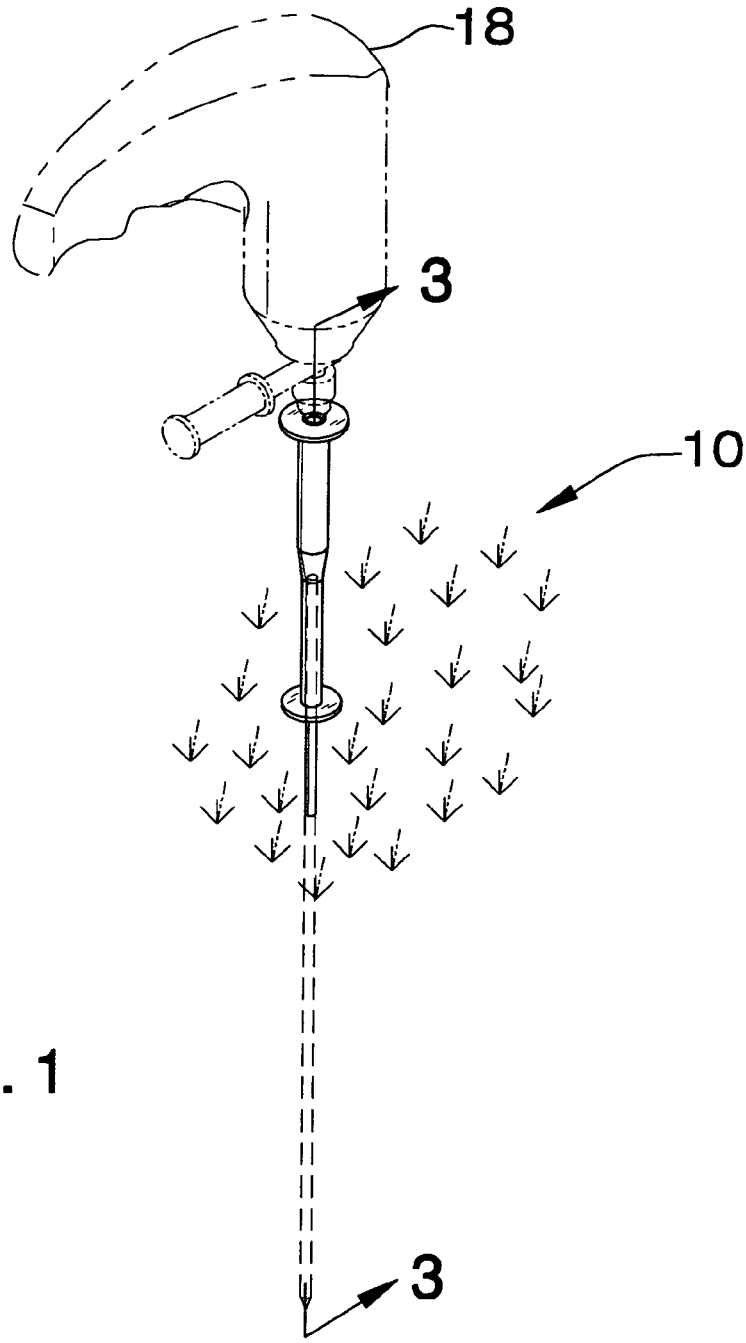
FIG. 1 is a perspective view of a method of inserting a grounding rod according to the present invention.
Figure 2:
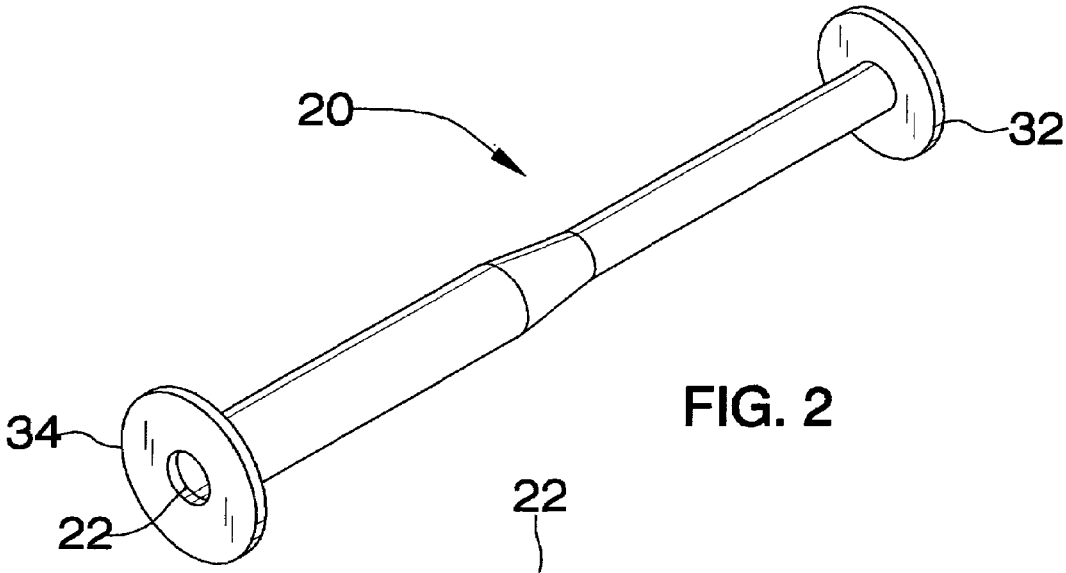
FIG. 2 is a perspective view of the present invention.
Figure 3:
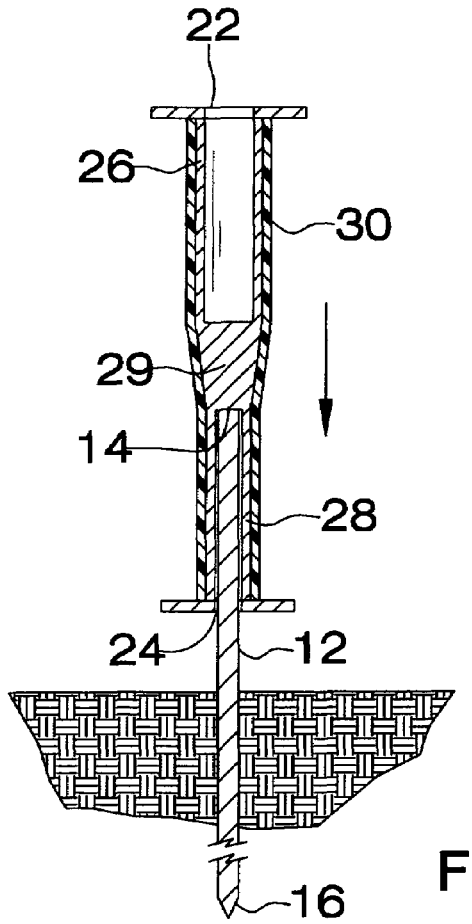
FIG. 3 is a cross-sectional view taken along line 3—3 of FIG. 1 of the present invention.

With reference now to the drawings, and in particular to FIGS. 1 through 3 thereof, a new grounding rod insertion device and method embodying the principles and concepts of the present invention and generally designated by the reference numeral 10 will be described.

As best illustrated in FIGS. 1 through 3, the method of inserting a grounding rod 10 generally comprises the steps of providing an elongated grounding rod 12 that has an upper end 14 and a lower end 16. The grounding rod 12 is conventional and the lower end 16 is preferably pointed. A hammer drill 18 is also provided which is of conventional construction.

An elongated tubular member 20 is provided which has an open first end and 22 an open second end 24. The tubular member 20 includes a first portion 26 positioned adjacent to the first end 22 and a second portion 28 positioned adjacent to the second end 24. A dividing wall 29 is integrally attached to an inner surface of the tubular member 20 and is positioned at a juncture of the first 26 and second 28 portions. The first portion 26 has a greater inner diameter than an inner diameter of the second portion 28. The inner diameter of the first portion 26 is at least 1⅛ inches and preferably is generally between 1⅛ inches and 1½ inches. The inner diameter of the second portion 28 is at least 13/16 inches and preferably is generally between 13/16 inches and 1 inch. Each of the first 26 and second 28 portions has a length generally between 3 inches and 6 inches. The elongated tubular member 20 is preferably comprised of a metallic material.

A resiliently compressible material 30 may be attached to and substantially covers an outer surface of the tubular member 20. The material 30 is preferably an elastomer.

A lower flange 32 is attached to the tubular member 20 and is positioned adjacently to the second end 24 of the tubular member 20. An upper flange 34 is attached to the tubular member 20 and is positioned adjacently to the first end 22 of the tubular member 20.

In use, the upper end 14 of the grounding rod 12 is extended into the second portion 28 of the tubular member 20 such that the upper end 14 abuts the dividing wall 29. The hammer drill 18 is engaged with the first portion 26 of the tubular member 20 by extending it into the first portion 26 such that it abuts the first end 22 of the tubular member 20. The hammer drill 18 is then turned on and downward force is placed on the tubular member 20 so that the lower end 16 of the grounding rod 12 is extended into a ground surface by the jackhammer action of the hammer drill 18. The lower flange 32 prevents the tubular member 12 from also being extended into the ground while the upper flange 34 provides better stability for the hammer drill 18. The compressible material 30 provides a comfortable grip on the tubular member 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of driving a grounding rod into a ground surface comprising the steps of:

providing an elongated grounding rod having an upper end and a lower end;

providing a hammer drill;

providing an elongated tubular member having an open first end and an open second end, said tubular member including a first portion positioned adjacent to said first end and a second portion positioned adjacent to said second end, a dividing wall being integrally attached to an inner surface of said tubular member and being positioned at a juncture of said first and second portions;

further providing a peripheral lower flange being attached to said tubular member and being positioned adjacently to said second end of said tubular member, said lower flange extending laterally away from said tubular member and being coextensive with said second end;

extending said upper end of said grounding rod into said second portion of said tubular member such that said upper end abuts said dividing wall;

engaging said hammer drill with said first portion of said tubular member; and turning on said hammer drill and placing downward force on said tubular member such that said lower end of said grounding rod is extended into a ground surface.

2. The method according to claim 1, wherein said first portion has a greater inner diameter than an inner diameter of said second portion.

3. The method according to claim 2, wherein said inner diameter of said first portion is generally between 1⅛ inches and 1½ inches and said inner diameter of said second portion is generally between 13/16 inches and 1 inch.

4. The method according to claim 3, wherein each of said first and second portions has a length generally between 3 inches and 6 inches.

5. The method according to claim 1, wherein each of said first and second portions has a length generally between 3 inches and 6 inches.

6. The method according to claim 1, further providing a resiliently compressible material being attached to and substantially covering an outer surface of said tubular member.

7. The method according to claim 1, further providing an upper flange being attached to said tubular member and being positioned adjacently to said first end of said tubular member, said upper flange being coextensive with said first end.

8. A method of driving a grounding rod into a ground surface comprising the steps of:

providing an elongated grounding rod having an upper end and a lower end;

providing a hammer drill;

providing an elongated tubular member having an open first end and an open second end, said tubular member including a first portion positioned adjacent to said first end and a second portion positioned adjacent to said second end, a dividing wall being integrally attached to an inner surface of said tubular member and being positioned at a juncture of said first and second portions, said first portion having a greater inner diameter than an inner diameter of said second portion, said inner diameter of said first portion being generally between 1⅛ inches and 1½ inches, said inner diameter of said second portion being generally between 13/16 inches and 1 inch, each of said first and second portions having a length generally between 3 inches and 6 inches;

providing a resiliently compressible material being attached to and substantially covering an outer surface of said tubular member, providing a lower flange being attached to said tubular member and being positioned adjacently to said second end of said tubular member, said lower flange extending laterally away from said tubular member, said lower flange being coextensive with said second end and extending around a perimeter of said tubular member;

providing an upper flange being attached to said tubular member and being positioned adjacently to said first end of said tubular member, said upper flange being coextensive with said first end and extending around the perimeter of said tubular member;

extending said upper end of said grounding rod into said second portion of said tubular member such that said upper end abuts said dividing wall, said grounding rod being unsecured to said tubular member;

engaging said hammer drill with said first portion of said tubular member; and turning on said hammer drill and placing downward force on said tubular member such that said lower end of said grounding rod is extended into a ground surface.

* * * * *